US008459454B2

(12) United States Patent
Goldberg

(10) Patent No.: US 8,459,454 B2
(45) Date of Patent: Jun. 11, 2013

(54) PACKAGING FOR WINDOW TREATMENTS

(75) Inventor: Michael S. Goldberg, Stanley, NC (US)

(73) Assignee: Hunter Douglas Inc., Pearl River, NY (US)

( * ) Notice: Subject to any disclaimer, the term of this patent is extended or adjusted under 35 U.S.C. 154(b) by 422 days.

(21) Appl. No.: 12/834,235

(22) Filed: Jul. 12, 2010

(65) Prior Publication Data

US 2011/0016830 A1 Jan. 27, 2011

Related U.S. Application Data

(60) Provisional application No. 61/227,551, filed on Jul. 22, 2009.

(51) Int. Cl.
*B65D 85/46* (2006.01)

(52) U.S. Cl.
USPC ..... 206/321; 206/586; 206/521

(58) Field of Classification Search
USPC ..... 206/586, 523, 591, 592, 583, 521, 206/321, 326; 248/345.1; 428/122
See application file for complete search history.

(56) References Cited

U.S. PATENT DOCUMENTS

| | | | | | |
|---|---|---|---|---|---|
| 2,720,964 | A * | 10/1955 | Hopper | 206/223 |
| 4,869,369 | A * | 9/1989 | Turngren | 206/523 |
| 5,323,905 | A * | 6/1994 | Gerondale et al. | 206/461 |
| 5,701,999 | A * | 12/1997 | Phillips et al. | 206/320 |
| 6,679,378 | B1 * | 1/2004 | Vermeulen et al. | 206/335 |
| 7,048,122 | B2 * | 5/2006 | Dodson et al. | 206/443 |
| 7,866,479 | B2 * | 1/2011 | Fan | 206/588 |
| 8,038,009 | B1 * | 10/2011 | McLaughlin | 206/583 |
| 2006/0283769 | A1 * | 12/2006 | Roesler | 206/588 |
| 2009/0065392 | A1 * | 3/2009 | Gustin | 206/586 |

* cited by examiner

*Primary Examiner* — David Fidei
(74) *Attorney, Agent, or Firm* — Camoriano and Associates

(57) ABSTRACT

A device and method for packaging and protecting window treatments to provide cushioning and protection against impact.

11 Claims, 12 Drawing Sheets

46
42
12
40
36
38
44

46'
42'
12'
36'
40'
38'
44'

26b
30
34
26
14
26t
24

32
28
34
24

30
26b
30
28
24
26t
24

14
26t
26
34
26b
24
36'
12'
46
36
12
44

28
14
24
26t
26b
12'
12

PACKAGING FOR WINDOW TREATMENTS

This application claims priority from U.S. Provisional Application Ser. No. 61/227,551, filed Jul. 22, 2009. The present invention relates to packaging for elongated, fragile products, such as window treatments, and in particular for window treatments such as blinds and roller shades.

BACKGROUND

Summary

One embodiment of packaging provides a foam end piece to capture, cushion, and protect each end of the window treatment by folding the foam end piece over itself and trapping the end of the window treatment within it. Each foam end piece in turn fits into a box to restrain its respective foam end piece, which keeps the end of the window treatment trapped within the foam end piece. Another box also may be used to stow any additional hardware items (such as mounting brackets, screws, and screw anchors) which are to ship with the window treatment. The boxes are axially aligned and shrink-wrapped (or stretch-wrapped) together with the window treatment to provide additional structural integrity to the final package while also providing dust protection and holding all the parts together in a single package.

DESCRIPTION

FIGS. 1 through 21 illustrate an embodiment of a packaged window treatment assembly 10. The term window treatment is used to mean a covering for an architectural opening, such as, but not limited to, a blind or roller shade. In the embodiments shown here, the window treatment is a blind.

Figure 1:
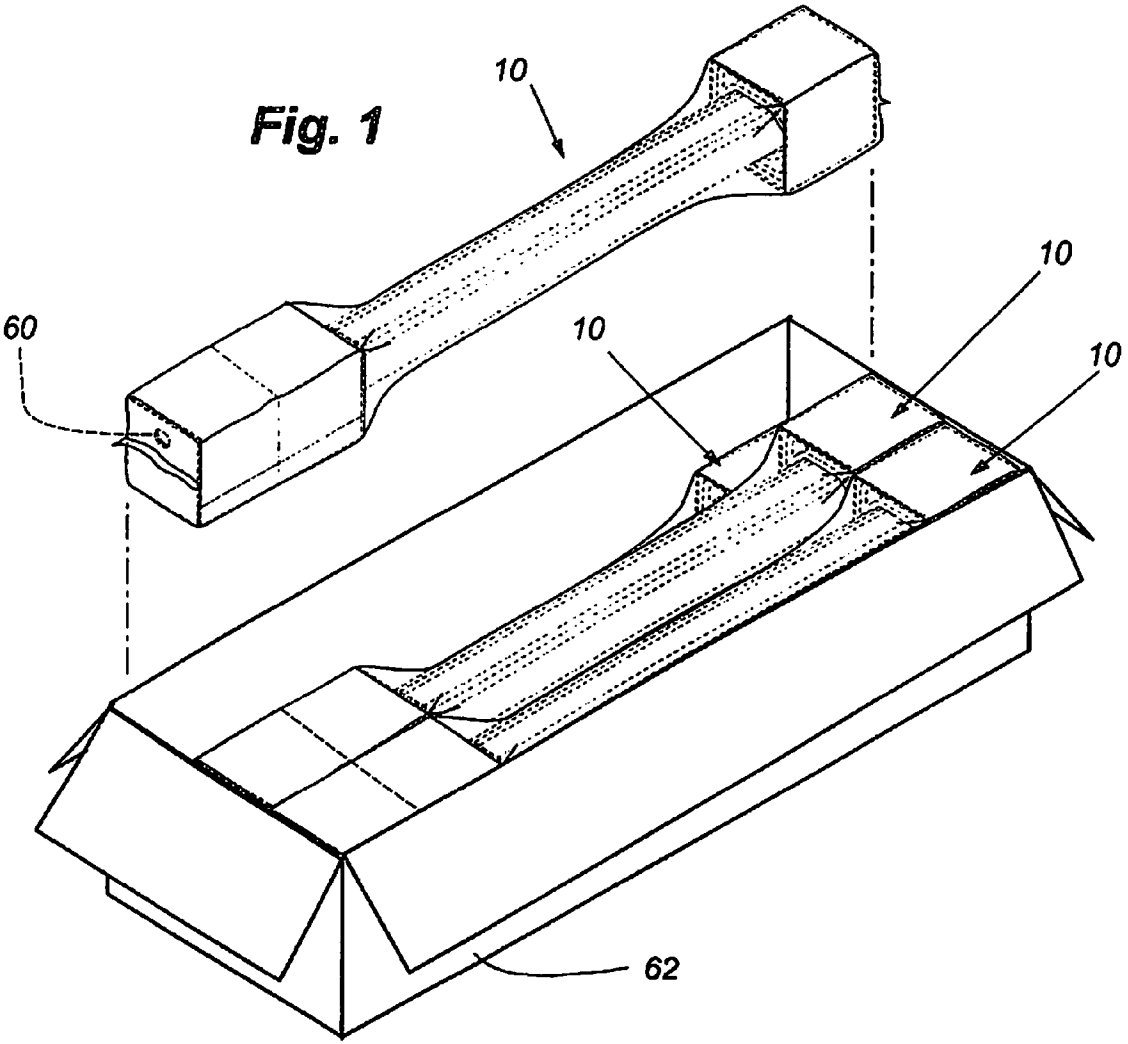
FIG. 1 is a perspective view of a window treatment which has been individually packaged and is about to be inserted into a box containing several other window treatments which are similarly packaged.
Figures 16, 17:
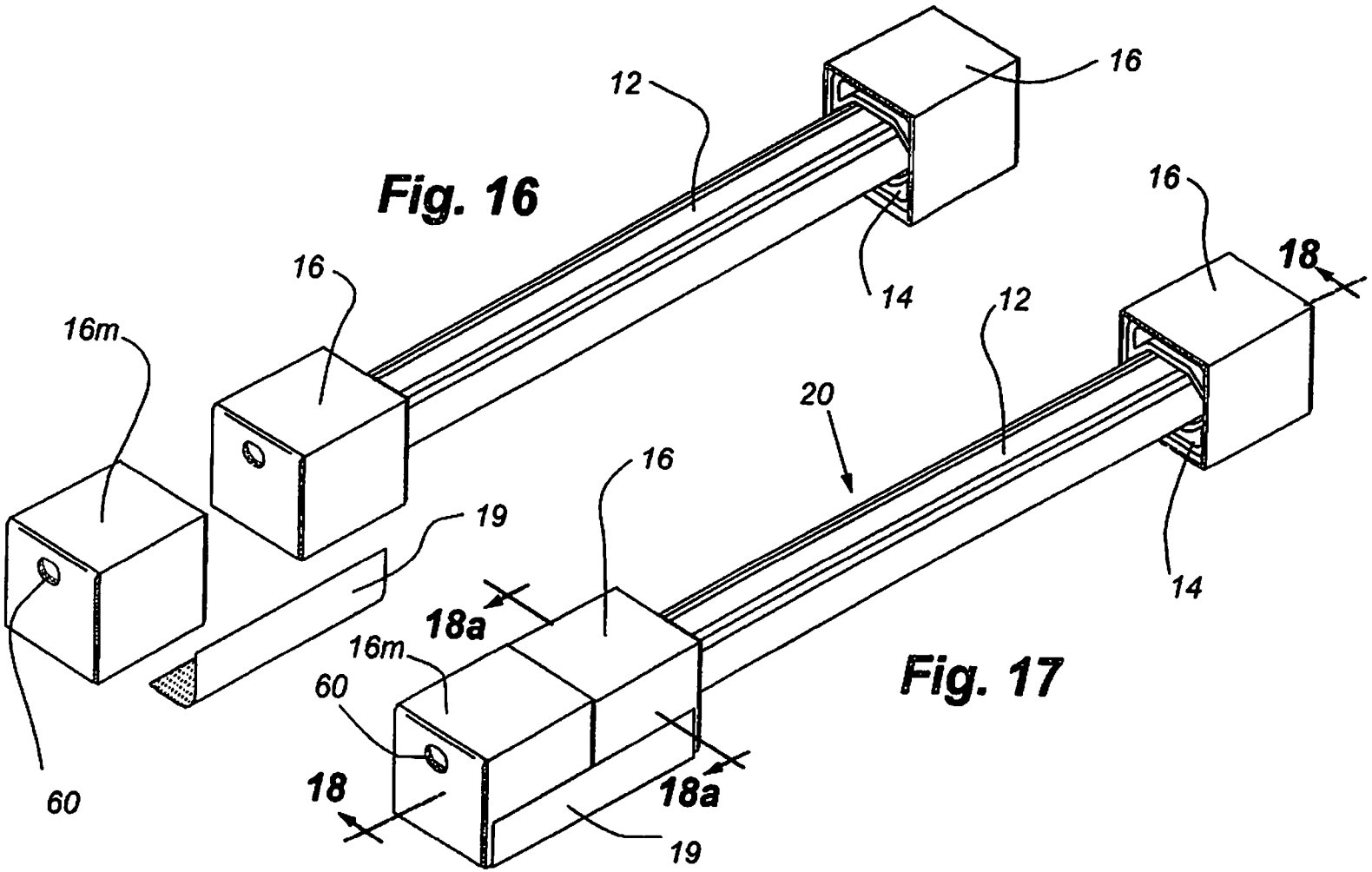
FIG. 16 is a partially-exploded, perspective view of the window treatment and elastically compressible end pieces of FIG. 9, with the open-ended boxes of FIG. 14 enclosing the elastically compressible end pieces and the ends of the window treatment, and including the box of FIG. 15 containing miscellaneous hardware items.
FIG. 17 is a perspective view of the assembled components of FIG. 16.
Figures 19, 20:
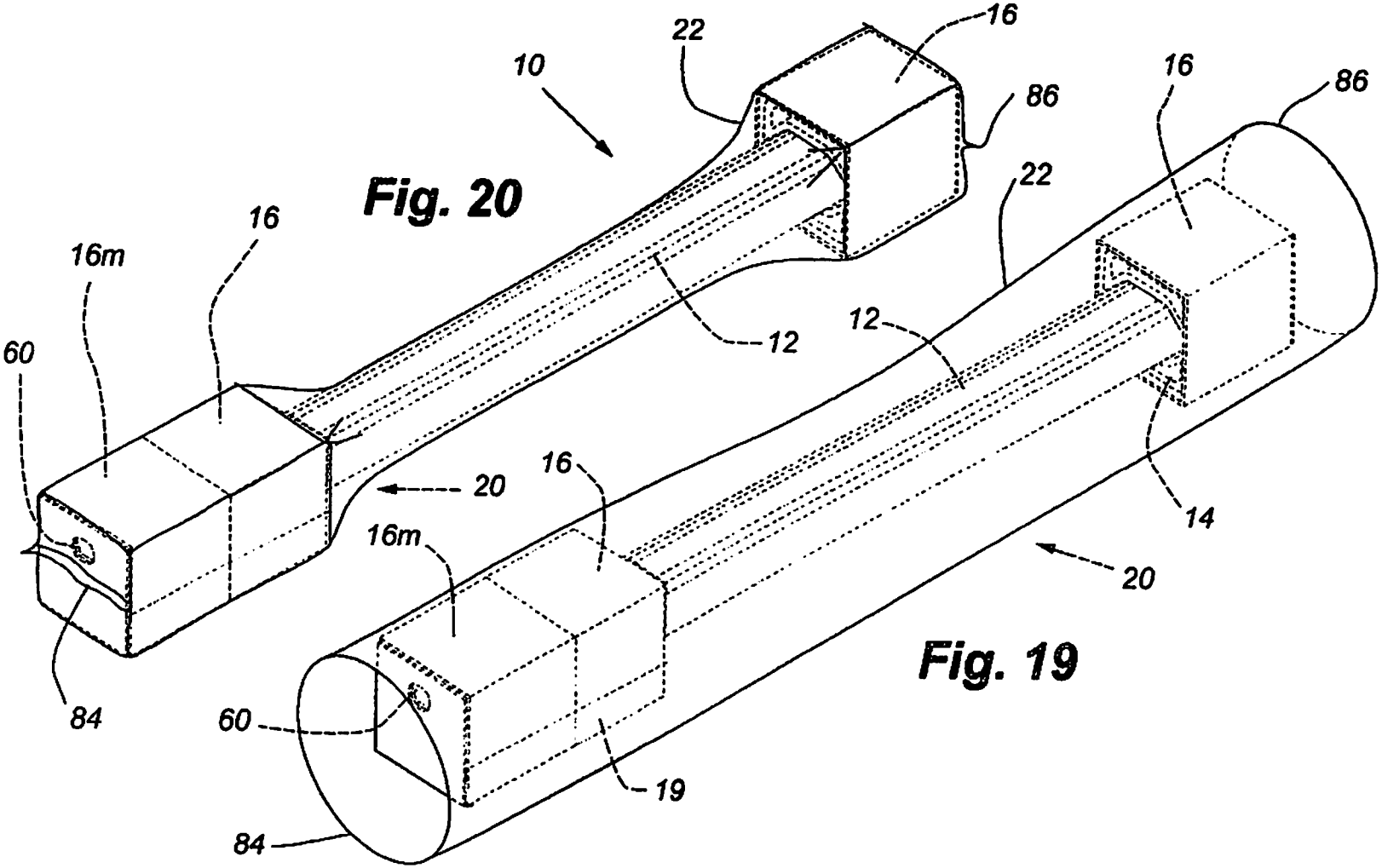
FIG. 19 is a perspective view of the assembled components of FIG. 17 as they are inserted into a tube of shrink wrap material.
FIG. 20 is a perspective view, identical to that of FIG. 19, but with the ends of the shrink wrap material sealed and the material shrunk over the packaged assembly.

Referring to FIGS. 1, 16, and 19, and as explained in more detail below, it may be appreciated that each packaged window treatment assembly 10 includes a window treatment 12 with its ends trapped inside elastically compressible end pieces 14 which are in turn housed in open-ended boxes 16. An additional box 16*m*, which is closed at both ends, packs miscellaneous hardware items which the installer may use to mount the window treatment 12 to a wall or window frame. This subassembly is held together by a strip of adhesive material 19, such as a piece of tape 19, to form a subassembly "train" 20 (See FIG. 17). This subassembly "train" 20 is wrapped in a protective film 22, such as shrink-wrap film or stretch-wrap film (See FIG. 19), its ends 84, 86 are sealed, and the film 22 is shrunk or wrapped tightly over the subassembly "train" 20, as shown in FIG. 20.

Figures 2, 3, 4, 5, 6:
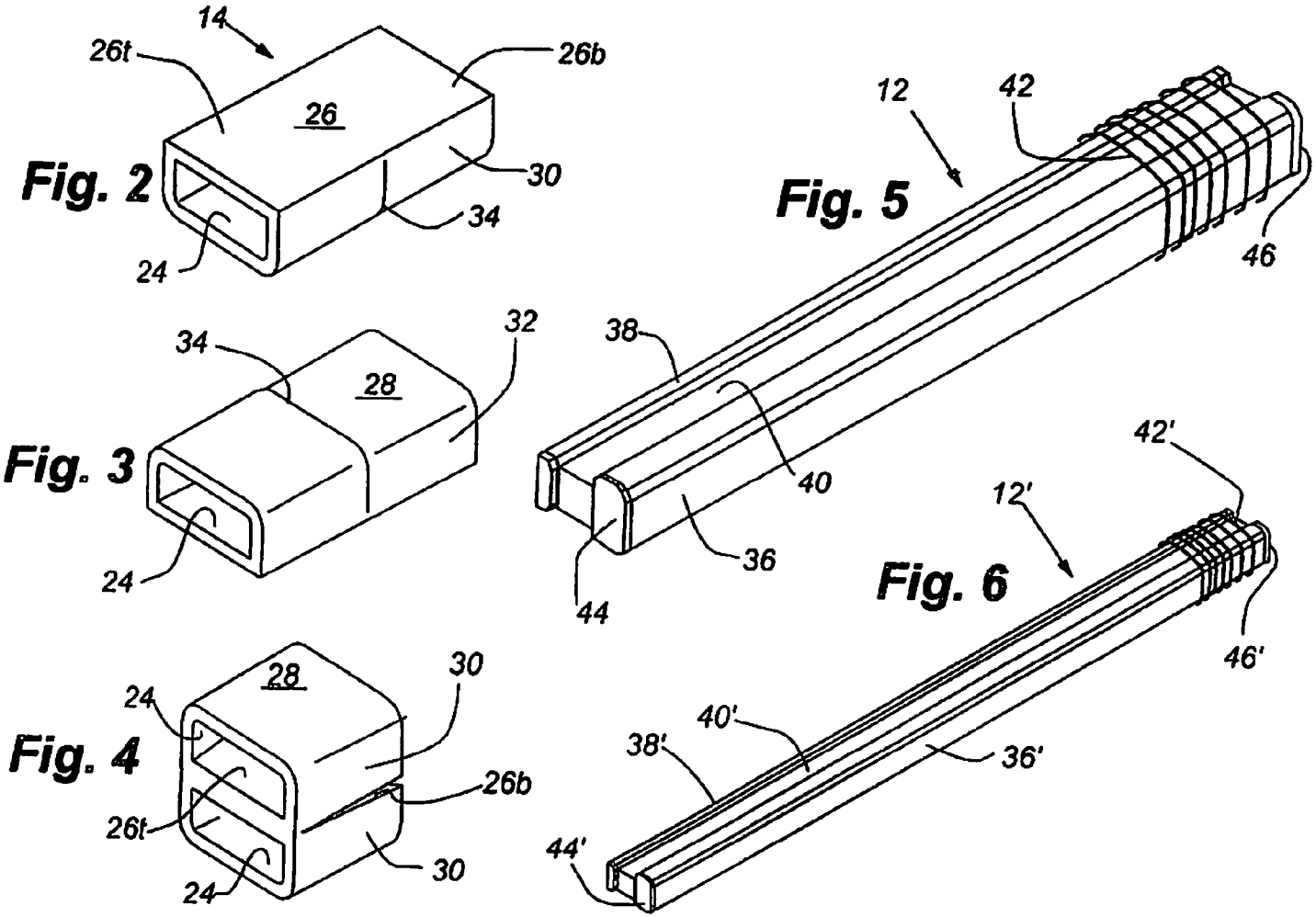
FIG. 2 is a perspective view of an elastically compressible end piece, used to protect the end of the window treatment of FIG. 1.
FIG. 3 is an opposite side perspective view of the elastically compressible end piece of FIG. 2.
FIG. 4 is a perspective view of the elastically compressible end piece of FIG. 2 but shown in its folded position.
FIG. 5 is a perspective view of a retracted window treatment, shown ready for packaging.
FIG. 6 is a perspective view of a retracted window treatment, similar to that of FIG. 5, but for a considerably smaller size unit.

Referring now to FIGS. 2, 3, and 4, in this particular example, the elastically compressible end piece 14 is a foam extrusion having a substantially uniform cross sectional profile, with an outer wall 26 and an inner wall 24, which defines an internal cavity 24. The distance between the outer wall 26 and inner wall 24 defines a substantially uniform wall thickness. The elastically compressible end piece 14 has substantially flat top and bottom walls 26, 28, respectively, and substantially flat front and rear side walls 30, 32. The intersections of the bottom wall 28 with the side walls 30, 32 are radiused, and the intersections of the top wall 26 with the side walls 30, 32 are more square. One preferred material for making the elastically compressible end piece 14 is polyethylene foam, although other materials could be used. The elastically compressible material is more compressible than the material from which the framework of the window treatment 12 is made and serves to protect that framework as the window treatment 12 is being transported and handled.

In this example, the elastically compressible end piece 14 has been manufactured as a continuous extrusion which is then cut along vertical planes to the desired length. Each elastically compressible end piece 14 is then further cut along the line 34, cutting through the bottom wall 28 and through most of the side walls 30, 32, stopping just short of the top wall 26, as best shown in FIGS. 2-4. This cut 34 is preferably located halfway between the ends of the elastically compressible end piece 14, allowing the elastically compressible end piece 14 to be folded back onto itself, as shown in FIG. 4, with what was the top wall 26 now abutting itself. As explained in more detail later, when the elastically compressible end piece 14 is folded back onto itself and wrapped around the end of the window treatment 12, the top wall 26 becomes two flexible internal webs 26*t*, 26*b* (See also FIG. 18), and these flexible webs 26*t*, 26*b* deform into the opening defined by the inner surface 24, capturing the end of the window treatment 12, as may be appreciated in FIG. 18*a*.

FIG. 5 shows a window treatment 12, which in this instance is a two-inch-deep blind including a head rail 36, a bottom rail 38, a plurality of slats 40, and a cord 42, which is wrapped around the retracted window treatment 12. FIG. 6 shows a similar window treatment 12', but this is a smaller, one-inch-deep blind, also including a head rail 36', a bottom rail 38', a plurality of slats 40', and a cord 42'.

Figures 7, 8:
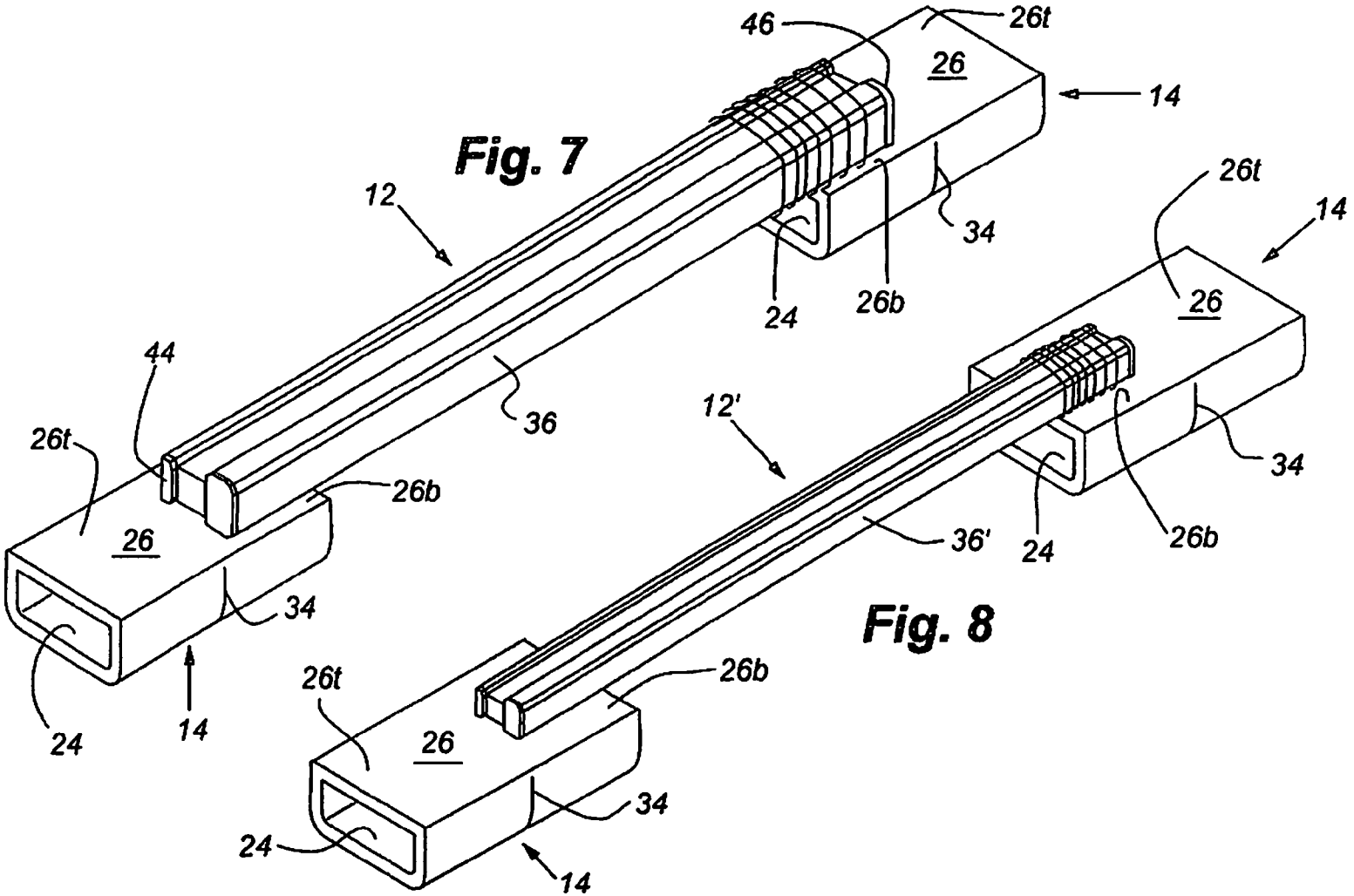
FIG. 7 is a perspective view of the window treatment of FIG. 5 resting on two of the elastically compressible end pieces of FIG. 2, in a first step in the process of packaging.
FIG. 8 is identical to FIG. 7, but for the smaller sized window treatment of FIG. 6.

FIG. 7 shows a first step in packaging the window treatment 12, wherein the window treatment 12 is placed with each of its ends 44, 46 resting on the top wall 26 of roughly one-half of one of the elastically compressible end pieces 14, with the respective end 44, 46 lying just short of the cut 34.

Figures 9, 10:
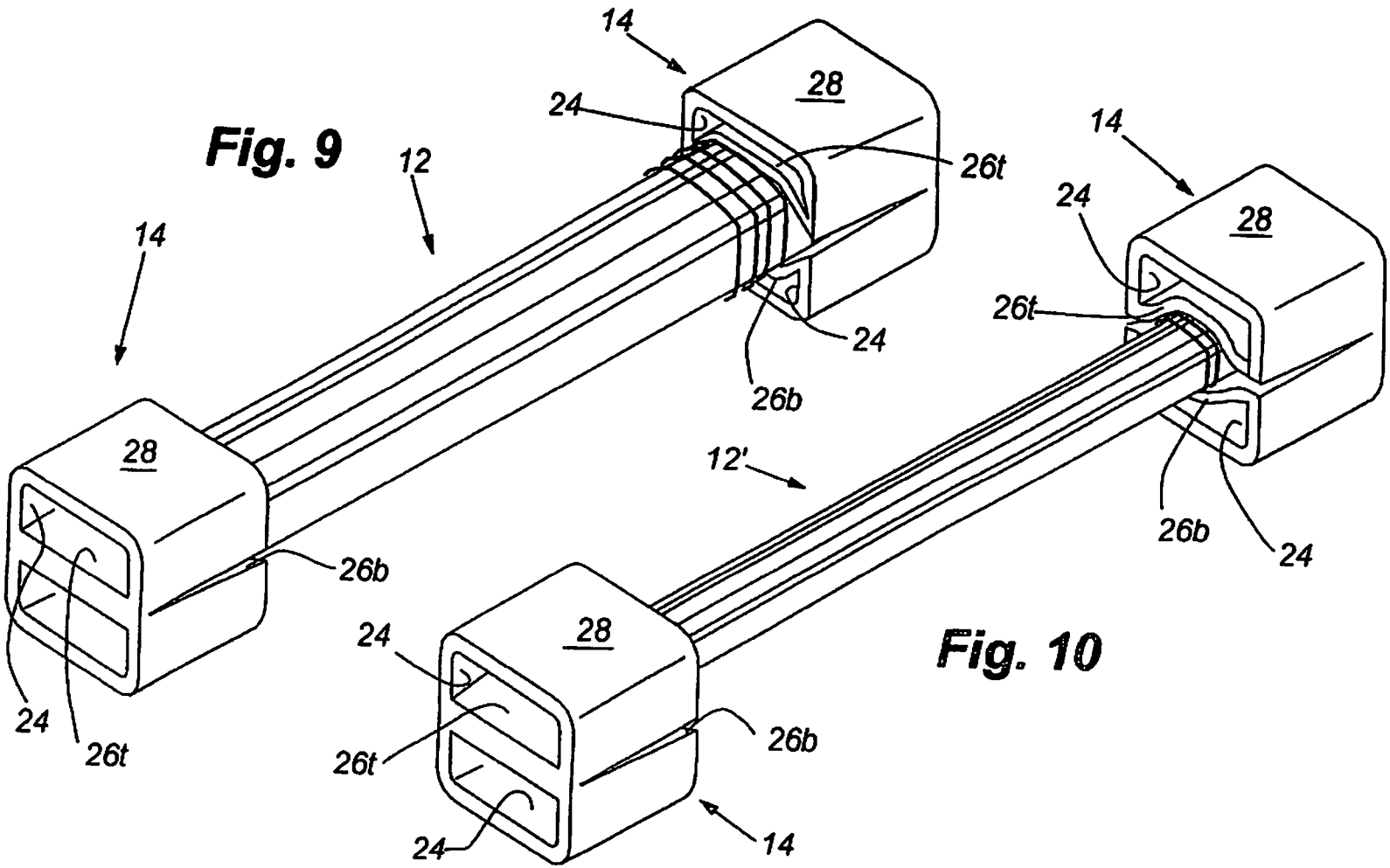
FIG. 9 is a perspective view of the window treatment and elastically compressible end pieces of FIG. 7 showing the end pieces being folded over onto themselves and wrapping around the ends of the window treatment in a second step in the process of packaging.
FIG. 10 is identical to FIG. 9, but for the smaller sized window treatment of FIG. 6.

FIG. 9 shows the second step in the packaging of the window treatment 12, wherein each of the elastically compressible end pieces 14 has been folded back onto itself at the cut 34, wrapping around the respective end 44, 46 of the window treatment 12. In the process, the top surface 26 becomes internal webs 26*t*, 26*b*, which flex and partially collapse into the internal cavity defined by the inner surface 24 of the folded elastically compressible end piece 14, reducing the cross-sectional area of the internal cavity. This can be seen in the right hand side of FIGS. 9 and 10, and in FIG. 18*a*.

FIG. 10 shows this same second step in the packaging of the window treatment 12' but for the smaller cross-section window treatment 12'. Notice that the same elastically compressible end pieces 14 are used in both instances, despite the difference in cross-sectional size of the window treatments 12, 12'. In the case of the smaller window treatment 12', the ends 44', 46' produce a lesser degree of collapse of the internal webs 26*t*, 26*b* into the cavity 24, as can be best appreciated by comparing the right hand side elastically compressible end pieces 14 in FIGS. 9 and 10.

If the elastically compressible end pieces 14 are simply folded back on themselves, wrapping around the ends 44, 46 of the window treatment 12, the force required to cause the partial collapse of the internal webs 26*t*, 26*b* results in a reactive force urging the elastically compressible end pieces 14 to spring back open to the condition depicted in FIG. 7. To prevent this from happening, and to further protect the end of the window treatment 12, each of the elastically compressible end pieces 14, along with the corresponding end 44, 46 of the window treatment 12 around which that end piece 14 is wrapped, is inserted into a box 16, which is described in more detail below.

Figure 13:
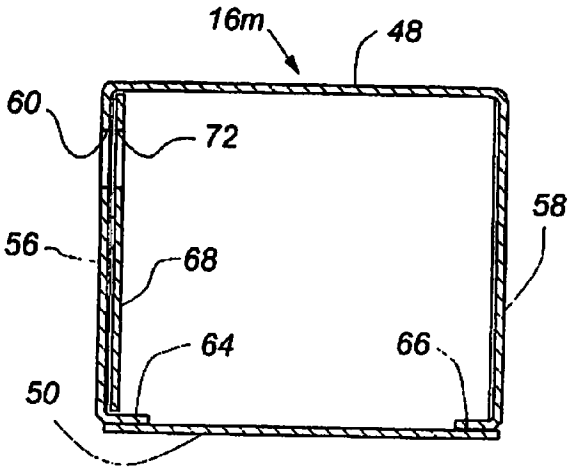
FIG. 13 is a view along line 13-13 of FIG. 12.
Figure 11:
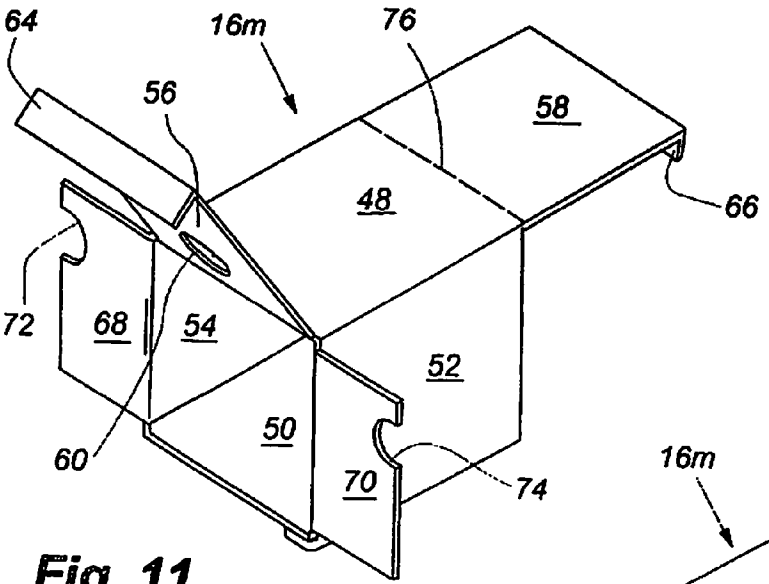
FIG. 11 is a perspective view of one of the boxes of FIG. 1, shown in an open position.
Figure 12:
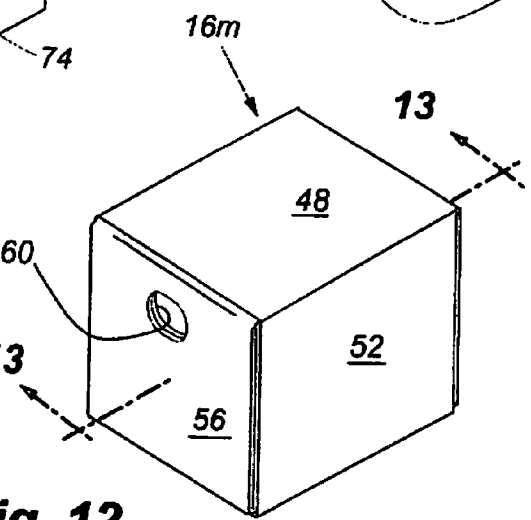
FIG. 12 is a perspective view of the box of FIG. 11 after it has been closed.

Referring to FIGS. 11, 12, and 13, the box 16*m* includes a top wall 48, a bottom wall 50, a front side wall 52, a rear side wall 54, a first end wall 56, and a second end wall 58. The first end wall 56 defines a through opening 60 which is large enough to insert an adult human finger, allowing it to be used as a finger hole 60 to pull the packaged window treatment assembly 10 out of the end of a box 62 (See FIGS. 1 and 21) as described in more detail later. The end walls 56, 58 include fold in lips 64, 66, respectively, to help secure these walls 56, 58 when the box 16 is closed. Two half flaps 68, 70 are hinged vertically (as opposed to the horizontal hinging of the walls 56, 58) to strengthen the closing of the first end wall 56, such that the entire packaged window treatment assembly 10 may be pulled out by the finger hole 60 without the wall 56 flying open and spilling the contents. It should be noted that the half flaps 68, 70 define semicircular openings 72, 74, respectively, which together form a circular opening that has the same dimensions as, and matches up with, the finger hole 60 when the box 16*m* is closed, as shown in FIG. 13.

Figure 14:
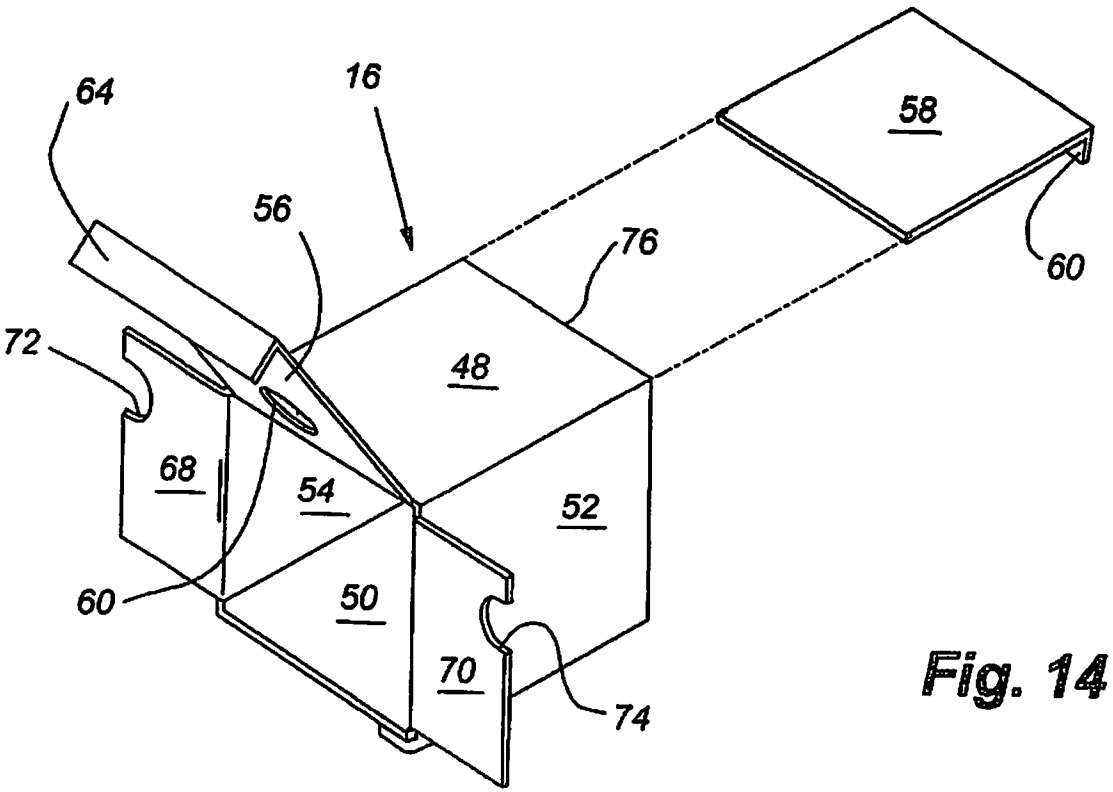
FIG. 14 is a perspective view of the box of FIG. 11, but with an end flap torn away.

FIG. 14 shows the box 16, which is identical to the box 16*m* described above, except that the second end wall 58 has been torn off at the horizontal hinge 76 which is scored (See also FIG. 11) to facilitate the task. The only difference between the box 16 and the box 16*m* described above is that the second end wall 58 of the box 16*m* is torn off to form the open-ended box 16. Note that the terms top, bottom, front, rear, left, and right as used in this specification are only relative terms to help describe and identify the components. The box 16 may be flipped so that top becomes bottom and front becomes rear, without changing the box or its functionality.

Figure 15:
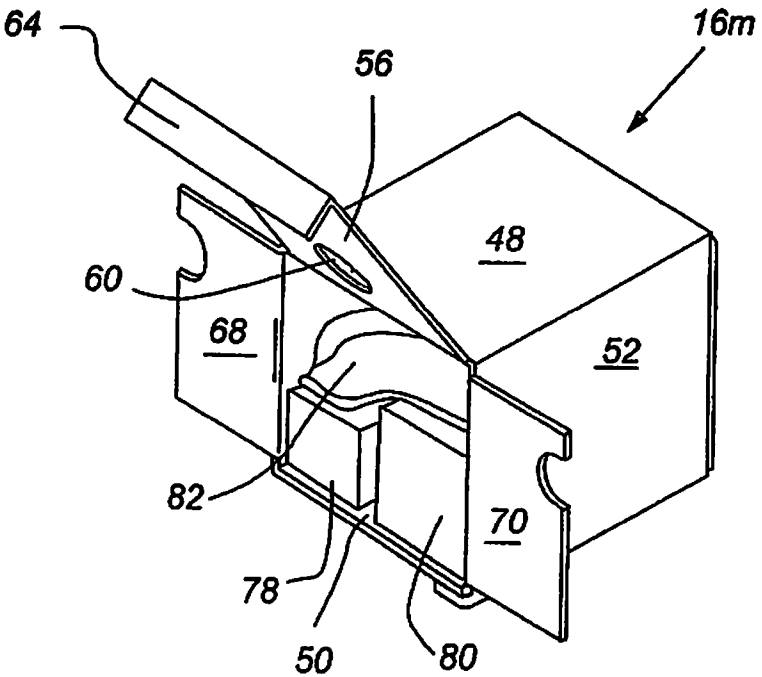
FIG. 15 is a perspective view of the box of FIG. 12, showing miscellaneous hardware items stored inside the box.

FIG. 15 shows how the box 16*m* may be used to store several miscellaneous items 78, 80, 82, such as mounting brackets and hardware, which the installer may need for mounting the window treatment 12 to a wall or window frame.

As indicated earlier, once the elastically compressible end pieces 14 have been folded back onto themselves, capturing the respective ends 44, 46 of the window treatment 12, as shown in FIGS. 9 and 10, each elastically compressible end piece 14 and the respective end 44, 46 of the window treatment 12 is inserted into the open end of a box 16, as shown in FIG. 16, with a tight fit between the elastically compressible end piece 14 and its respective box 16 and with the flat outer surfaces of the end piece 14 abutting the flat inner surfaces of the box 16. This prevents the elastically compressible end piece 14 from springing back to an open position and ensures that the ends 44, 46 of the window treatment 12 remain captured between the webs 26*t*, 26*b* of the elastically compressible end pieces 14. It also provides additional protection to the ends 44, 46 of the window treatment 12, with the box 16 serving as a protective shell.

The end wall 56, and the half flaps 68, 70 are closed as shown in FIG. 16. The miscellaneous items 78, 80, 82 are stored in the box 16*m*, and it too is closed and placed in axial alignment with the boxes 16 and with the window treatment 12, as shown in FIG. 16. An adhesive strip 19 is used to temporarily hold the box 16*m* containing the hardware to one of the boxes 16 containing the end of the window treatment 12 so as to form a subassembly "train" 20, as shown in FIG. 17.

Figure 18:
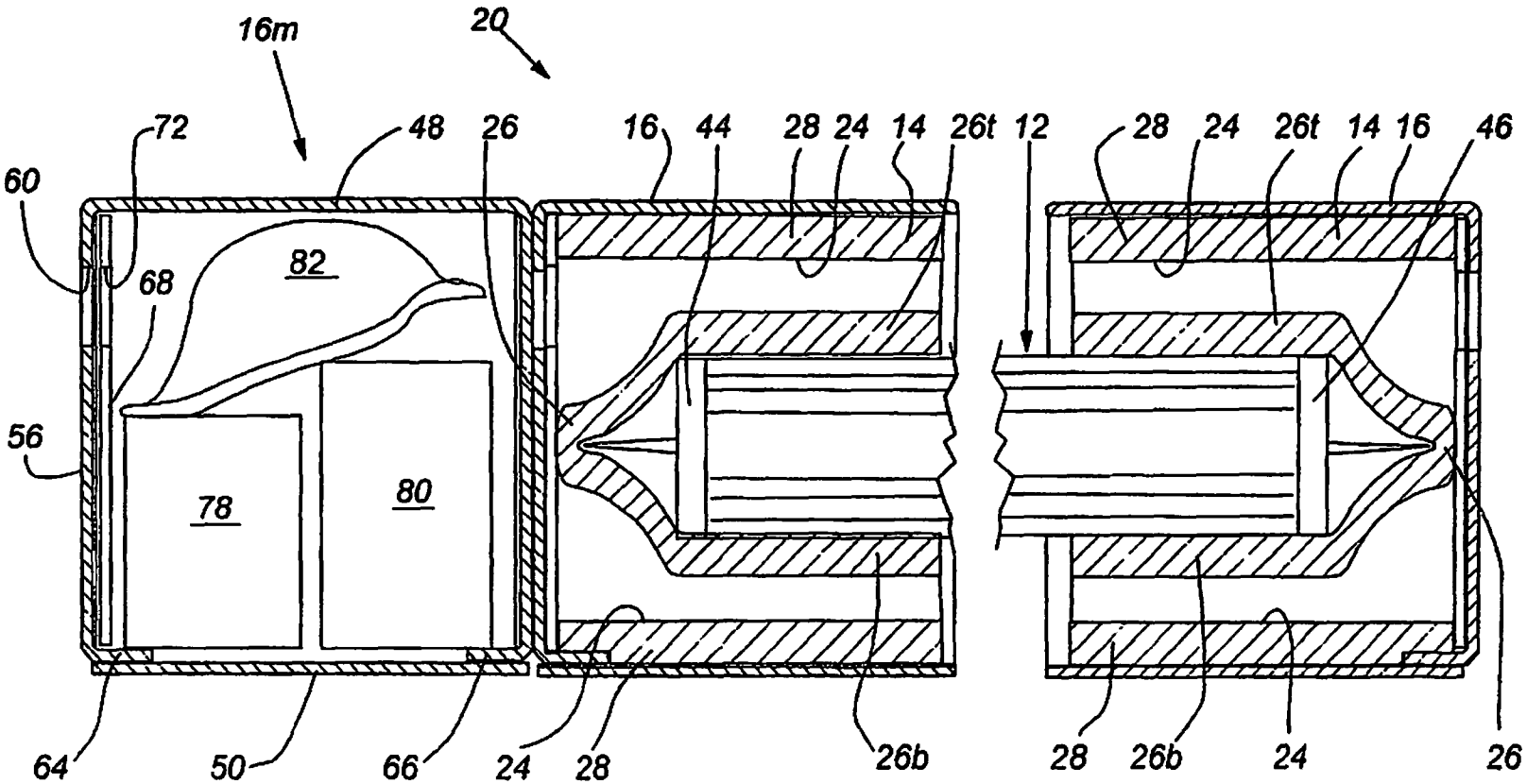
FIG. 18 is a partially broken away view along line 18-18 of FIG. 17.
Figure 18A:
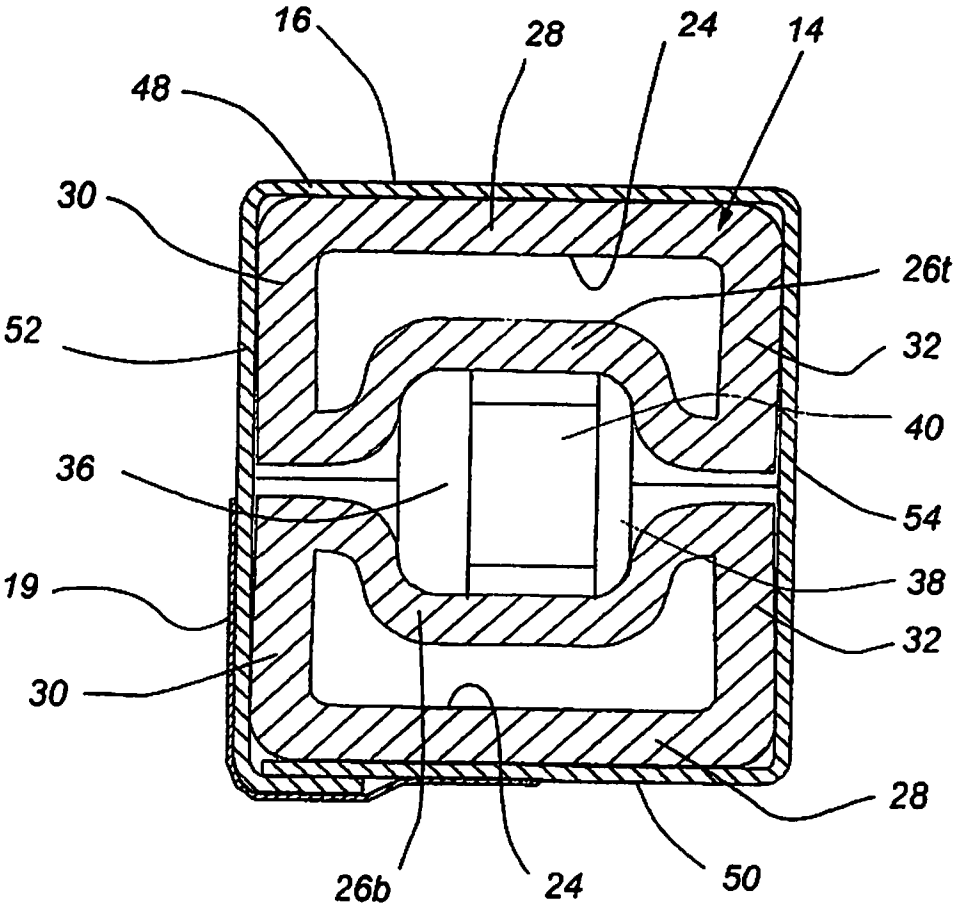
FIG. 18*a* is a view along line 18*a*-18*a* of FIG. 17.

FIGS. 18 and 18*a* are section views along line 18-18 and line 18*a*-18*a* respectively of FIG. 17, showing the subassembly "train" 20. It can be seen that the ends 44, 46 of the window treatment 12 are captured between the flexed and partially collapsed internal webs 26*t*, 26*b* of the elastically compressible end pieces 14, while there still remains an air space or cavity 24 between the internal webs 26*t*, 26*b* and the wall 28 of the elastically compressible end pieces 14. Should the packaged window treatment assembly 10 be dropped or otherwise experience a sudden acceleration or deceleration, the internal webs 26*t*, 26*b* may temporarily collapse further or shift within the cavity 24, but they will spring back to the position shown in FIGS. 18 and 18*a* once the impact is over, readying them for any subsequent impacts. The elastically compressible material of the end pieces 14 also may partially collapse in other directions in order to cushion any shocks, and then elastically return to its original configuration. It also should be noted, as shown in FIG. 18, that the folded ends of the elastically compressible end pieces 14 form a tapered opening for receiving the ends 44, 46 of the window treatment 12, and the dimensions of that tapered opening are such that they do not permit the ends 44, 46 of the window treatment 12 to extend all the way to the folded end of the elastically compressible end pieces 14, thereby leaving a longitudinal space between the end 56 of the box 16 and the respective end 44, 46 of the window treatment 12. This longitudinal gap is created automatically when the elastically compressible end piece 14 is folded over the end of the window treatment, because the portion of the elastically compressible end piece 14 adjacent to the end that includes the fold in the wall 26 cannot deform as much as the portion farther away from the fold and therefore does not permit the end of the window treatment 12 to extend all the way to the fold. Thus, the elastically compressible end pieces 14 provide cushioning and protection against multiple impacts having acceleration (or deceleration) vectors in the longitudinal (axial) direction and in the lateral (radial) direction.

In the event of a sudden deceleration of the packaged window treatment assembly 10, the first line of protection is provided by the flexibility of the internal webs 26*t*, 26*b* which may collapse further and/or shift within the cavity 24 to absorb some of the energy of the impact over a longer time period to keep the deceleration rate to within acceptable levels to prevent damage to the window treatment 12. A second line of protection is provided by the thickness and resiliency of the walls of the elastically compressible end pieces 14. Should the impact be so strong as to cause the internal webs 26*t*, 26*b* to "bottom out" (that is, cause them to shift to the extent that the cavity between one or both of the webs 26*t*, 26*b* and the external wall of the elastically compressible piece is reduced to zero), the elastically compressible walls, both of the internal webs 26*t*, 26*b* and of the elastically compressible piece external walls 28, 26, enter into play to also absorb some of the energy of the impact, again providing a degree of protection to prevent damage to the window treatment 12. After the impact event is over, the elastically compressible walls spring back to their original condition, and the internal webs 26*t*, 26*b* also spring back to their original positions, ready to protect the window treatment 12 against subsequent impacts.

Referring now to FIGS. 19 and 20, the subassembly "train" 20 is inserted into a shrink-wrap film tunnel or tube 22. The ends 84, 86 of the shrink-wrap film tunnel 22 then are sealed, and the film is shrunk around the subassembly "train" 20. Other wrapping methods, such as stretch-wrap film may be used instead of, or in addition to, the shrink-wrap film 22. The shrink-wrap film 22 provides additional structural integrity to the packaged window treatment assembly 10, as well as providing dust protection and aiding in keeping all the components which may be needed for an installation together in a single package. As explained below, it also provides the package strength needed to allow the installer to pull and slide out a packaged window treatment assembly 10 directly from a shipping box 62 (See FIG. 21) which may contain a plurality of packaged window treatment assemblies 10 without "opening" the shipping box 62.

Figure 21:
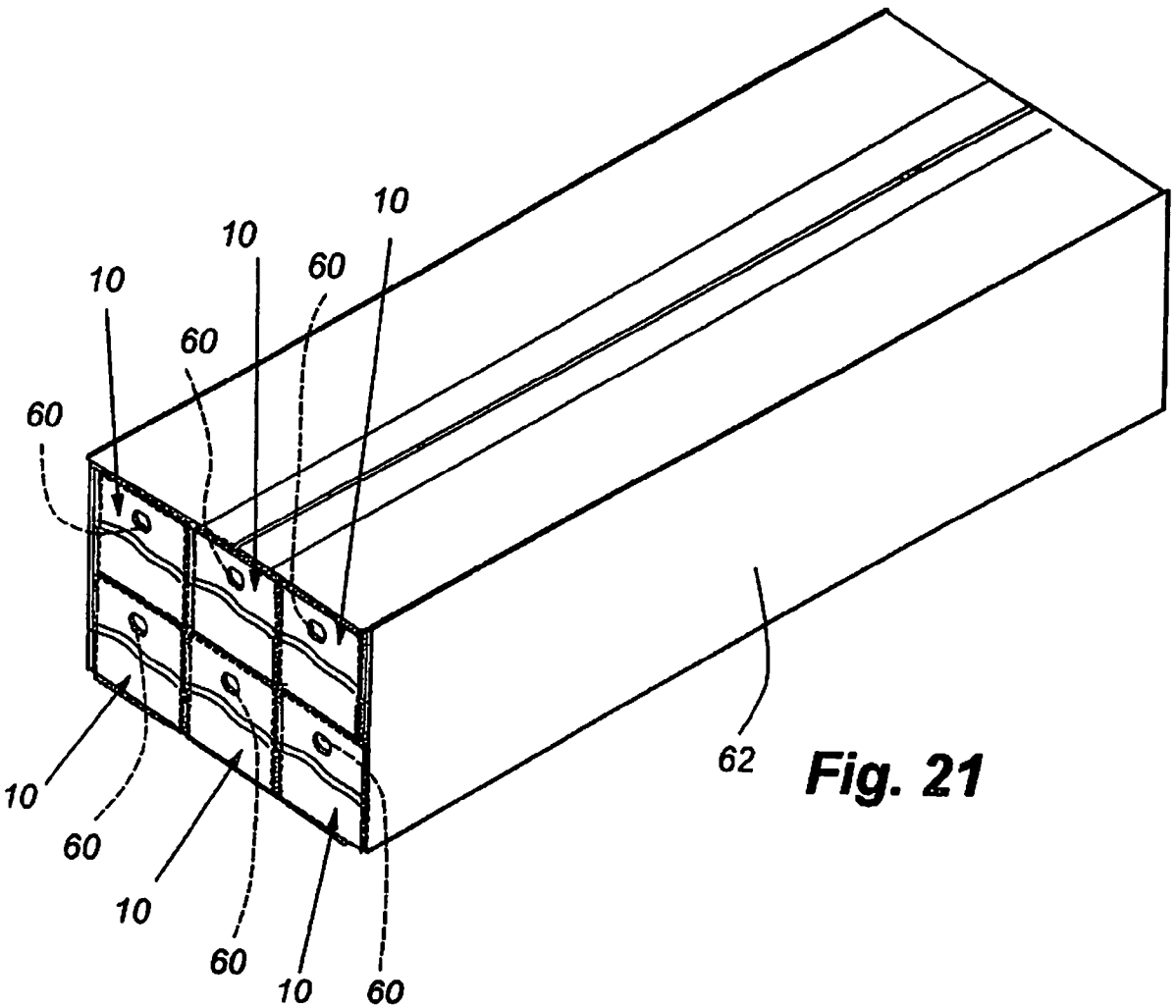
FIG. 21 is a perspective view of the shipping box of FIG. 1, fully packed and closed, and with and end of the box torn off to reveal, and provide access to, the packaged window treatments stored inside.

As shown in FIGS. 1 and 21, the packaged window treatment assemblies 10 may be placed in a box 62 for shipment. Once the box 62 has arrived, the installer may place the box 62 directly on a rack in his work vehicle and drive to the job site. Instead of opening up the box 62, he may just tear off or cut off an end of the box 62, exposing one end of all of the packaged window treatment assemblies 10 packed therein. He may then reach in and slide out one of the packaged window treatment assemblies 10 by pressing his finger into the shrink wrap film 22 to deform the film or punch a hole in it, inserting his finger into the finger hole opening 60, and then pulling on the end wall 56 of the packaged window treatment assembly 10 he needs in order to drag that assembly 10 out of the end of the box.

It will be obvious to those skilled in the art that modifications may be made to the embodiment described above without departing from the scope of the present invention as defined by the claims.

What is claimed is:

1. A device for packaging a window treatment, comprising:

an elastically compressible piece having a substantially uniform cross-sectional profile having a substantially flat tubular shape with an outer surface and an inner surface which defines an internal cavity, with the distance between the outer and inner surfaces defining a substantially uniform wall thickness, said elastically compressible piece having substantially flat top and bottom walls, and having front and rear side walls, and defining a vertical cut extending through the bottom wall and through most of the height of the front and rear side walls, stopping lust short of the top wall; wherein said elastically compressible piece is made of a foam material and has first and second ends, and said cut is located substantially halfway between the first and second ends of said elastically compressible piece;

and further comprising an open ended box having top, bottom, front, and rear walls, and a first end wall and being open at the other end, said open ended box being sized to receive and surround the foam piece with a close fit when the foam piece is folded onto itself about said cut.

2. A device for packaging a window treatment as recited in claim 1, wherein the first end wall of said open ended box defines a finger hole large enough to receive an adult human finger.

3. A device for packaging a window treatment as recited in claim 2, wherein said elastically compressible piece is a polyethylene extrusion.

4. A device for packaging a window treatment, comprising:

an elastically compressible piece having a substantially uniform cross-sectional profile having a substantially flat tubular shape with an outer surface and an inner surface which defines an internal cavity, with the distance between the outer and inner surfaces defining a substantially uniform wall thickness, said elastically compressible piece having substantially flat top and bottom walls, and having front and rear side walls, and defining a vertical cut extending through the bottom wall and through most of the height of the front and rear side walls, stopping just short of the top wall;

and further comprising a window treatment having first and second window treatment ends; and a first open-ended box, which includes an end wall, top and bottom walls, and front and rear side walls;

wherein said elastically compressible piece is folded onto itself along its respective cut and is wrapped around the first window treatment end so the top surface of the elastically compressible piece encloses the top and bottom surfaces of the first window treatment end; and wherein the first window treatment end with the elastically compressible piece is inside said first open-ended box, with the remainder of the window treatment projecting out the open end of said first open-ended box, and said first open-ended box surrounds the top, bottom, front and rear sides of the window treatment and surrounds said first window treatment end, including surrounding the elastically compressible piece that is wrapped around said first window treatment end, and wherein the elastically compressible piece is more elastically compressible than said first window treatment end.

5. A device for packaging a window treatment as recited in claim 4, wherein said elastically compressible piece has a substantially "D" shaped cross sectional profile.

6. A device for packaging a window treatment as recited in claim 5, wherein there is a snug fit between said elastically compressible piece and the first open-ended box, and the top surface of said elastically compressible piece is partially collapsed into said internal cavity where the elastically compressible piece is wrapped around the first window treatment end, thereby reducing the cross-sectional area of said internal cavity.

7. A device for packaging a window treatment as recited in claim 6, and further comprising a second elastically compressible piece and a second open-ended box which surround the second end of said window treatment; and further comprising a plastic wrap enclosing the window treatment and the first and second open-ended boxes and the respective elastically compressible pieces.

8. A device for packaging a window treatment as recited in claim 7, wherein said plastic treatment is selected from the group consisting of shrink wrapping and stretch wrapping.

9. A device for packaging a window treatment as recited in claim 4, wherein said open ended box has at least one wall which defines a finger hole large enough to insert an adult human finger.

10. A device for packaging a window treatment as recited in claim 9, wherein said finger hole extends through the end wall of the open ended box.

11. A device for packaging a window treatment as recited in claim 8, wherein said each of said first and second open ended boxes has a finger hole in the end wall which is large enough to insert an adult human finger.

* * * * *